US007959102B2

(12) United States Patent
Lanz

(10) Patent No.: US 7,959,102 B2
(45) Date of Patent: Jun. 14, 2011

(54) WINDER FOR A METERIAL WEB OF FLEXIBLE MATERIAL

(75) Inventor: Werner Lanz, Pfäffikon (CH)

(73) Assignee: Swiss Winding Performance AG, Jona (CH)

( * ) Notice: Subject to any disclaimer, the term of this patent is extended or adjusted under 35 U.S.C. 154(b) by 0 days.

(21) Appl. No.: 12/287,484

(22) Filed: Oct. 9, 2008

(65) Prior Publication Data

US 2009/0101746 A1 Apr. 23, 2009

(30) Foreign Application Priority Data

Oct. 12, 2007 (CH) ..... 1598/07

(51) Int. Cl.
*B65H 18/26* (2006.01)

(52) U.S. Cl. ..... 242/541.1; 242/541.4; 242/541.5; 242/541.6; 242/541.7

(58) Field of Classification Search ..... 242/541, 242/541.1, 541.3–541.7, 563
See application file for complete search history.

(56) References Cited

U.S. PATENT DOCUMENTS

| | | | | |
|---|---|---|---|---|
| 3,834,642 | A | 9/1974 | Kampf | |
| 4,191,341 | A * | 3/1980 | Looser | 242/541.4 |
| 4,550,882 | A * | 11/1985 | Hutzenlaub et al. | 242/527.5 |
| 5,249,758 | A * | 10/1993 | Muller et al. | 242/533.3 |
| 5,308,008 | A * | 5/1994 | Ruegg | 242/541.7 |
| 6,325,232 | B1 * | 12/2001 | Luttmann et al. | 220/276 |
| 6,834,824 | B1 * | 12/2004 | Smith | 242/530.1 |

FOREIGN PATENT DOCUMENTS

| | | |
|---|---|---|
| CH | 666014 | 6/1988 |
| CH | 678419 | 9/1991 |
| CH | 686885 | 7/1996 |
| DE | 2037979 | 2/1971 |
| DE | 2214350 | 10/1973 |
| DE | 2264587 | 5/1974 |
| DE | 3308059 | 9/1984 |
| DE | 3627463 | 2/1988 |
| DE | 3736696 | 9/1988 |
| EP | 0017277 | 10/1980 |
| EP | 0561128 | 9/1993 |
| EP | 1167256 | 1/2002 |
| GB | 1099750 | 1/1968 |
| WO | WO-9852858 | 11/1998 |
| WO | WO-03/035521 | 1/2003 |
| WO | WO-03/076320 | 9/2003 |

OTHER PUBLICATIONS

Haaken, Willy, International—Type Search Report for CH15982007 as mailed Apr. 24, 2008 ( 4 pages).

* cited by examiner

*Primary Examiner* — Sang Kim
(74) *Attorney, Agent, or Firm* — Winstead PC

(57) ABSTRACT

The machine control 30 drives the winder 1 according to the invention in such a manner that for the winding of a reel 6, the pair of supporting arms 17 is continuously moved away from the contact roller 4 in accordance with the calculated desired radius of the reel 6 which is building up. The contact roller is exposed to the contact pressure through the cylinder arrangement 24 and remains in its desired position without any perturbations (out-of-round reel, incorrectly calculated desired radius) but in the event of perturbations, can avoid the perturbation due to its floating mounting.

19 Claims, 1 Drawing Sheet

WINDER FOR A METERIAL WEB OF FLEXIBLE MATERIAL

BACKGROUND

1. Field of the Invention

The present invention relates to a winder.

2. History of the Related Art

Such winders are known and wind a usually freshly produced, endless, flexible material web onto a winding core until a reel of predetermined size is wound. The material web is then cut and the finished reel is preferably flyingly replaced by a new winding core, so that a new reel can be produced without delay and as far as possible without material loss.

The flexible material web is frequently a plastic film but can also consist of other materials. In particular, plastic films are produced in an extraordinary multiplicity of compositions and accordingly with various properties, which then also influence the winding behavior and accordingly must be taken into account during winding. Likewise, the respective production speed as well as the number of reels to be produced in a production run are parameters which must be taken into account for satisfactory-quality production at the same time as reasonable costs.

Typical processing speeds range from 2 to 1000 m/min, while the finished winding bales can have a diameter of 50 to 2000 mm or a width of 10 to 4000 mm. The thickness can range from a few micrometers as far as the millimeter range. Depending on the requirement, the production varies between the manufacture of only a few dissimilar winding bales as far as the mass production of identical winding bales.

The winding itself is effected, depending on the material properties of the flexible material web, for example, as contact winding in which a contact roller maintains contact with the forming bale and thus applies a pressing force thereon. Accordingly, the winding is also effect as gap winding, i.e. without a contact roller touching the winding bale during the winding. Apart from a few exceptions, the flexible material web is guided in front of the winding bale around a contact roller, which helps to smooth the material web before winding, especially if the diameter is large.

The pressing force, along with the web tension, is a critical parameter for the quality of the winding bale and must be adjusted as optimally as possible with regard to the (numerous, see above) material properties. For example, the pressing force should be selected correctly according to the friction of the material web or film layers among one another, likewise after adding lubrication to the formulation of the material web. Frequently, the pressing force must be varied during winding, e.g. depending on the diameter of the reel which is building up.

The web tension of the material web looping around the contact roller can now, depending on the geometry of the winder or the suspension of the contact roller, result in a force component, which is added to the pressing force already produced. In the present case, it is assumed that the web tension has no influence in this regard or is appropriately taken into account by the person skilled in the art when designing the winding, so that it is superfluous to take into account feasible perturbations of the pressing force due to the web tension in the description of the present invention.

The optimal pressing force, always in regard to a good-quality reel, is dependent on the material properties such as, for example, friction, stickiness, lubricant content, and not least air ingress between the layers of the material web to be wound, accordingly also on the progress (diameter) of the forming reel. In other words, it is the formulation of the material which determines its winding properties; frequently, the formulation is an operating secret of the respective manufacturer. From the many-faceted nature of the influences on the winding properties of the material to be wound, it also follows that merely a small variation in the pressing pressure can change the quality of the winding.

Optimal pressing pressure therefore also means constant pressing pressure, i.e. without fluctuations, due to which the quality of the reel can be negatively influenced.

An important example for the quality of the reel is the defective formation of the roll level (end faces of the reel), i.e. layers displaced with respect to one another in the reel, which are visible at the sides of the reel, similar to an annual ring in a tree trunk. At the sides of the winding bales, even slightly protruding edges of the material web or the film tend to fold over, at the latest during unwinding, with the result that cracks can then form at the edges of the material web, which result in the unwound film being rejected. Thus, for example, for certain packaging tasks, the plastic film to be unwound is multiply stretched during the unwinding. The smallest winding defects then lead to tearing of the film, which results in an interruption in production with corresponding damage.

In other words, winding defects are tabooed, but are a frequent problem which is not least caused by nonoptimal pressing pressure.

Overall, it is found that a winder must generally be configured as a universal winder, which can be operated with tolerable retrofitting times for changing production. This includes the fact that contact winding or gap winding can be carried out, furthermore flying change of the reel, and the winding in the range of the aforesaid various parameters.

The numerous designs known today can be summarized in three groups: (i) static (i.e. rigid) mounting of the winding core bearing and dynamic (movable) mounting of the contact drum, see DE 33 08 059, where in the case of contact winding, the advance of the contact drum is regulated as a function of the pressing force, (ii) dynamic mounting of the winding core bearing and static mounting of the contact drum, see DE 2 037 979, where the advance of the winding core carrier is also regulated as a function of the pressing force and (iii) dynamic mounting of the winding core bearing and contact roller, see EP 0 561 128, where the advantages of static and dynamic mounting particularly in regard to the protruding residual material (material loss) at the finished reel after the flying change should be combined.

Common to all three examples is the fact that the quality of the winding bale should be improved compared with the prior art.

Likewise it is the object of the present invention to provide a method for improved winding of a web of flexible material and a winder, which is suitable for gap and contact winding, and can be used universally, and which further improves the quality of the reel produced during contact winding.

Since the winder core is continuously displaced from the contact roller, completely uniform operation of the winder is achieved under ideal conditions, so that perturbing influences on the pressing force e.g. due to the inertial mass of the accelerated contact roller or the accelerated reel are avoided; this is with the advantage of a statically mounted contact roller with regard to the flying change of reel with little protruding residual material. Also absent, for example, are the pulsations in the generally hydraulic feed drive of contact roller and reel, which perturb the uniform pressing force, and which are difficult to avoid during stepwise or cyclic feeding of the reel or with a contact roller which moves to and from, and which have an unfavorable effect on the pressing pressure. Since the contact roller can be displaced from its desired position while maintaining the pressing force, errors occurring when the desired radius does not correspond to the actual radius remain further without consequence. In addition, pulsations or impacts caused by out-of-round reels are intercepted and damped, thus preventing high force peaks from building up in the pressing pressure. Finally, in addition to the improved contact winding, gap winding is furthermore also possible, likewise the usual requirements for a universal winder are satisfied as previously.

SUMMARY OF THE INVENTION

An exemplary embodiment is characterized in that a method for producing a reel from a web of flexible material, which is guided over a contact roller of a winder and is wound therein onto a winding core to a winding bale, during the winding, the contact roller is pressed onto the reel with a contact pressure and thereby keeps continuous contact with said reel, at the same time the winding core is continuously moved away from the contact roller at a displacement speed, which is determined independently of the contact pressure and corresponds only to the increasing desired radius of the forming reel, until a predetermined winding progress of the reel is achieved, wherein optionally if the actual radius of the reel deviates from the desired radius, the contact roller is appropriately displaced from its desired position due to the continuously held contact with the reel, and wherein during such a displacement of the contact roller from its desired position, the displacement speed is adapted in such a manner that the contact roller returns back to its desired position, whereafter the winding core is again moved further away at the desired speed and an optionally renewed displacement of the contact roller from its desired position is corrected by the then necessary adaptation of the displacement speed until the predetermined winding progress of the reel is achieved.

A corresponding winder for carrying out this method is configured with a carrier arrangement which comprises a winding core bearing for receiving a winding core of a reel to be wound, a contact roller, a device for varying the relative position between winding core bearing and contact roller during the winding, means for producing a contact pressure persisting during the winding between the reel and the contact roller, and comprising a machine control, and characterized in that the contact roller is mounted floatingly around a desired position in the direction of the winding core bearing and away therefrom, and sensors are provided for detecting the actual position of the contact roller, the means for generating the contact pressure cooperate operatively with the contact roller, the device has a drive, which is configured to move the winding core bearing from a starting position at the beginning of winding away from the desired position of the contact roller until a predetermined winding progress is achieved, and the control is configured to operatively trigger the drive in such a manner that the winding core bearing (15) is moved substantially continuously away from the desired position of the contact roller independently of the action of a pressing force transmitted through the contact roller, at a speed which continuously corresponds to the instantaneous increase in the desired radius of the winding bale which occurs during winding, wherein in the event of a displacement of the contact roller from its desired position, the displacement speed is varied by the control in such a manner that the contact roller goes back into its desired position.

Since the displacement speed is adapted, in addition to the formulated object, a function corresponding to the static mounting of the contact roller is obtained with the associated advantages in the constructive design of the winder (easy to achieve flying change, simple drive for the pressing pressure, e.g. no double-carriage design is necessary as disclosed by CG 678 419, favorable machine dimensions) while at the same time, the adaptation of the displacement speed can be selected to be so small and gentle that the pressing pressure is negligibly negatively influenced with respect to a certain material. This concept is particularly advantageous if not only small but also large to very large reels are to be produced, since the difference between desired radius and actual radius of the reel is added over large diameters without adapting the displacement speed.

A closed control loop for direct control of the contact pressure as is usual in the prior art is advantageously absent. Such a control loop behaves in a manner very prone to vibration due to the load surges which occur frequently during operating of a winder (out-of-round reel), due to the continuous frequency variations as a result of the number of revolutions decreasing with increasing reel radius, and due to the long dead times of an electronic/hydraulic control loop.

BRIEF DESCRIPTION OF THE DRAWINGS

A more complete understanding of the device of the present invention may be obtained by reference to the following detailed description, taken in conjunction with the accompanying drawings, wherein.

DETAILED DESCRIPTION OF ILLUSTRATIVE EMBODIMENTS OF THE INVENTION

Figure 1:
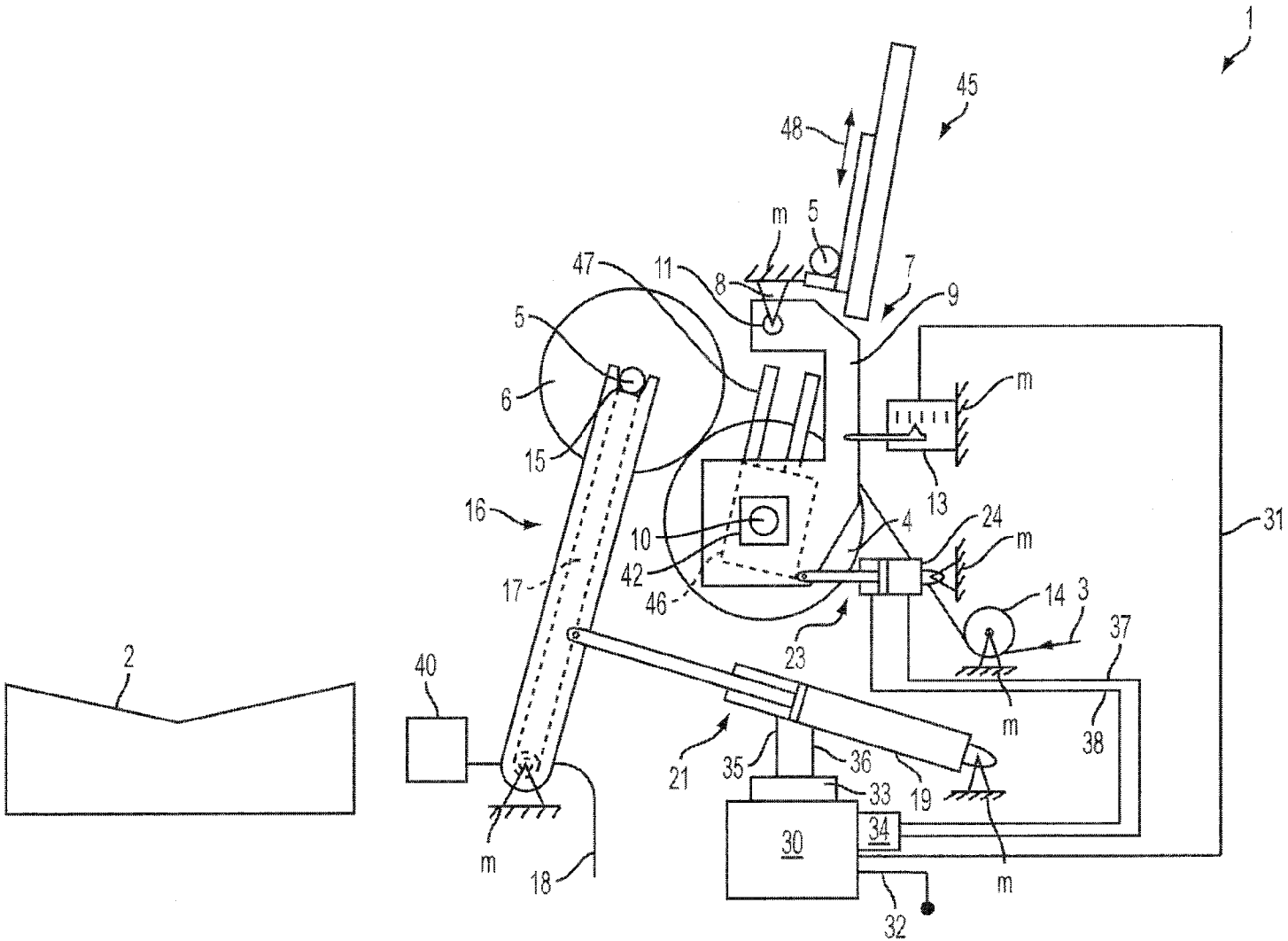
FIG. 1 is a schematic diagram of a winder according to an embodiment.

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and fully convey the scope of the invention to those skilled in the art.

FIG. 1 shows a winder 1 according to the invention, with a depositing unit 2 for ready-wound reels, wherein a flexible material web, in this case a film 3, runs over a contact roller 4, is wound onto a winding core 5, and wound to form a reel 6.

The contact roller 4 is mounted in a bearing arrangement 7, which is configured as pendulum and for its part is suspended in the winder 1 by means of a pivot bearing 8, which is fixed with respect to the machine frame, and is indicated merely schematically in FIG. 1. This comprises a pivot frame 9, in which a shaft 10 of the contact roller 4 is mounted. The shaft 4 is optimally disposed in such a manner that it is located perpendicularly below the pivot bearing 8 when the bearing arrangement 7 hangs freely in the rest position; then, the shaft 10 and the contact roller 4 are located at their lowest point, which corresponds to the desired position of the contact roller 4.

The bearing arrangement 7 can be mounted, for example, in the pivot bearing 8 by an axle 11 parallel to the shaft 10. In this case, the bearing arrangement 7 is suspended in such a manner that the possible pivoting movement of the contact roller 4 about its desired position takes places toward the reel 6 and away therefrom (or toward the winding core bearing 15 and away therefrom, see below). Furthermore, a sensor 13 for detecting the actual position of the contact roller 4 is connected to the pivot frame 9.

In other words, the contact roller 4 is mounted floatingly about a desired position in the direction of the winding core bearing 15 and away therefrom.

The reel 6 is mounted with its winding core 5 in a winding core bearing 15 of a carrier arrangement 16. The carrier arrangement 16 preferably has a pair of supporting arms 17 for the winding core 5, which is pivotable about a supporting arm axis 18.

The shaft 10 of the contact roller 4, the axle 11, the alignment of the winding core bearing 15, and the supporting arm axis 18 run parallel.

A device 21 for varying the relative position of the contact roller 4 and the winding core bearing 15 possesses a drive, in this case a hydraulic cylinder arrangement 19, which is on the one hand articulated to a schematically indicated machine frame M and on the other hand, connected to the pair of supporting arms 17. Thus, the pair of supporting arms 17 can be pivoted, i.e. the winding core bearing 15 can be moved away or pivoted away from the contact roller 4.

Means 23 are further provided for producing a contact pressure which persists during winding between the reel 6 and the contact roller 4, which comprise a preferably pneumatic cylinder arrangement 24, which is, on the one hand, articulated to a schematically indicated machine frame M and on the other hand, connected to the pivot frame 9.

Finally, FIG. 1 shows schematically a machine control 30 connected to a control line 31 of the sensor 30 and connected to a control line 32 for input of data by a controller or for data exchange with a line control. The machine control 30 is connected to a hydraulic unit 33 for the cylinder arrangement 19 and to a pneumatic unit 34 for the cylinder arrangement 24, wherein the hydraulic—pneumatic units 33, 34 for their part are connected via hydraulic and pneumatic lines 35, 36 or 37, 28 to the cylinder arrangements 19, 24.

A motor 40 sets the winding core 5 in rotation by means of a toothed belt indicated by the dot-dash line 41, so that the winder 1 can be moved with the so-called central winding. Likewise, a motor 42 is provided, which can drive the contact roller 4 for the conventional contact winding.

A feed device 45 known per se, for winding cores 5 is located above the pivot frame 9. Provided in the pivot frame 9 or also in the machine frame M is an auxiliary receiving device 46 for winding cores to be freshly wound; this has forks 47 provided on both sides of the contact drum 4.

Instead of hydraulic cylinder arrangements, pneumatic cylinder arrangements can also be provided by the person skilled in the art or other actuating drives of any design, insofar as these can be driven by the machine control 30, as described hereinafter. It is likewise feasible to provide, instead of the pair of supporting arms 17 or the pivot frame 12, carriages etc. which can be moved to and from, provided that the functionally necessary range of movement is then provided.

During operation of the winder according to the invention, the necessary operating parameters are input by the operator via the data line 32, inter alia the information required to determine the desired radius of the reel 6. In addition to the contact pressure corresponding to the material to be wound, this also includes the thickness "d" of the film to be wound. The length "l" of the continuously wound film can be suitably recorded by means of a length sensor, e.g. via the number of revolutions of a deflecting roller 14 or it can be continuously input into the control 30 via the line control.

Starting from a starting position of the winding core bearing at the beginning of the winding, the control then calculates, by means of the product of length "l" and the thickness "d" of the wound film, the running increase in the desired radius of the reel 6 and the resulting desired distance of the winding core bearing 6 from the contact roller 4 and generates the relevant control signal for the hydraulic unit 33. This then feeds the lines 35, 36 accordingly so that the pair of supporting arms 17 pivots accordingly from the starting position after the beginning of winding, i.e. moves continuously away from the contact roller. The displacement speed of the winding core bearing 15 is, in other words, independent of the contact pressure.

At the same time, the machine control 30 drives the cylinder arrangement 24 via the pneumatic unit 34 in such a manner that the contact roller 4 exerts the input contact pressure onto the reel 6 and thereby maintains continuous contact with the reel 6.

During winding, the winding core bearing 15 therefore moves continuously away from the contact roller 4 at a desired displacement speed corresponding to the increasing desired radius of the reel 6 which is building up. Its position remains unchanged as long as the desired radius of the reel 6 which is building up corresponds to the actual radius. Due to the continuous movement of the pair of supporting arms 17, a highly constant contact pressure is obtained without the faults known in the prior art, which unavoidably occur (i) as a result of the stepwise displacement of reel 6 and/or contact drum 4 and (ii) as a result of the adjustment of the displacement movement with reference to the actual contact pressure.

Regarding the stepwise displacement, it is particularly disadvantageous that the necessary start/stop acceleration of reel 6 and contact roller 4 result in inertial forces which not only cannot be compensated by the regulation or control system but additionally themselves negatively influence these. The frictional forces, in particular the adhesive friction, also play a role here which should not be underestimated. At the beginning of a stepwise movement of reel 6 and contact roller 4, it is necessary to overcome the adhesive frictional force which, depending on the design of the winder, frequently has high values, and then drops abruptly to the level of the sliding friction force. This implies that the minimum permissible contact pressure must at least have the value of the adhesive friction force, which is too high for some applications; if a lower contact pressure is allowed, it follows that after overcoming the adhesive friction, an undesirable contact pressure peak must be accepted until the regulation system has adjusted the contact pressure down to the lower value.

During adjustment of the displacement movement by means of the actual contact pressure, the fastest possible and very finely responding adjustment is necessary by the nature of the matter, since the winding quality deteriorates rapidly if the contact pressure is not immediately corrected before it then runs away into an impermissible range. With the accordingly high weight of the reel 6 and with an optionally large contact roller 4, which also has an appreciable mass, rapid adjustment is not completely eliminated but it can only satisfactorily be achieved with a very great constructive expenditure.

By means of the method according to the invention and the corresponding device, these problems are improved and in addition, solved with constructively simple means.

Another perturbation which adversely affects a constant contact pressure, lies in the frequently occurring, out-of-round reel with nonconstant radius, usually caused by a non-centrally running winding core 5. Since the contact roller 4 is floatingly mounted, it can follow the contour of an out-of-round reel 6 without excessive contact peaks occurring. The reel itself has only a certain elasticity; furthermore, actuating drives for constant working pressure (in this case: for constant contact pressure) under pulsating loading are available on the market under reasonable conditions. As a result of the construction according to the invention, such perturbations therefore no longer lead to inadmissible contact pressure peaks (or contact pressure drops).

In this connection, the pendulum-like suspension (in contrast to possibly a linearly displaceable carriage) of the contact roller 4 on the pivot frame 12 is an advantage: if the contact roller is displaced from its desired position, a restoring force in the direction of the desired position arises due to its weight, which helps to overcome the adhesive friction forces which occur following a possibly short standstill of the displacement movement.

If the desired radius and actual radius of the reel 6 do not agree, whether this be due to incorrect input of the thickness d, or due to variation of the thickness d during production of the film or due to the drift of another parameter, the floatingly mounted contact roller 4 can easily follow the actual profile of the reel 6 as a result of the constant contact pressure by the cylinder arrangement 24.

The sequence described continues until predetermined winding progress is achieved, usually the finished reel 6, or exceptionally as far as a predetermined phase in the creation of a reel 6.

In an exemplary embodiment, the machine control 30 continuously retrieves the actual position of the contact roller 4 via the control line 31 and generates a correction for the displacement speed calculated by way of the determination of the desired radius.

If the actual radius of the reel 6 is smaller than the calculated desired radius, e.g. because the actual thickness of the film 3 is smaller than the value input by the operator via the control line 32 (or, for example, due to drift of the thickness d), the contact roller is displaced from its desired position forward toward the reel 6, which is detected via the sensor 13. The machine control then adapts the displacement speed to the actual radius, by slowing this so that the contact roller 4 pushes over the further increasing actual radius of the reel 6, returning to its desired position. As soon as this is the case, the displacement speed is increased again. If, conversely, the actual radius of the reel 6 is greater than the desired radius, the contact roller is displaced from its desired position rearward away from the reel, whereupon the displacement speed is accordingly conversely adapted so that the displacement of the contact roller 4 is again reversed. This regulating mechanism is optionally repeated in the respectively required direction and until the predetermined winding progress is achieved.

The adaptation of the displacement speed is then preferably made in steps so that after a first adaptation step, it is detected whether the contact roller (4) is already displaced back into its desired position (for example, it could only come to a standstill outside its desired position), in which case the adaptation has been made or, if the contact roller (4) has not yet been displaced back toward the desired position, a further adaptation step is carried out, and then it is again detected whether the contact roller (4) is displaced back, and so on, until the contact roller (4) is actually displaced back into its desired position, that is the desired correction effect is achieved.

The adaptation of the displacement speed is therefore made as gently as possible and does not perturb the contact pressure.

If the desired radius is systematically incorrectly determined, e.g. due to an incorrect input of the thickness d of the film 3, the regulating mechanism described above is repeated many times and without delay as soon as the contact roller 4 has reached its desired position again. After, for example, three to five, preferably four or another number of such cycles, which bearing in mind the increase in radius (number of revolutions becoming slower, displacement speed becoming slower etc.), are substantially identical, the machine control 30 preferably corrects the thickness d, for example, by 0.5, 1, 2 or more percent of the input thickness d, so that the calculated desired radius better corresponds to the actual radius and the regulation leaves the otherwise endless regulating loop by adapting the displacement speed.

It is likewise advantageous if the machine control detects a displacement of the position of the contact roller 4 which pulsates synchronously to the number of revolutions of the reel 6. Such a displacement is produced by an out-of-round reel; a correction in the sense described above by continuous adaptation of the displacement speed is only appropriate to a certain extent. The control 30 therefore determines the displacement interval of the position of the contact roller 4 given by the pulsation, and the centre of this interval. The displacement speed is then adapted in such a manner that the centre of the interval is returned into the desired position of the shaft 10 of the contact roller 4. This correction can be made for itself or together with the correction of the displacement speed described above (in the event of the drift of a parameter).

If the machine control 30 detects an out-of-round reel, the contact pressure of the contact roller 4 can be temporarily slightly increased if the contact roller 4 is pressed by the out-of-round reel from the desired position into the rear area of the displacement interval. This can counteract an increase in the out-of-round profile of the reel 6 and support the smoothing of the profile.

In all the case of regulation described above, the displacement speed can advantageously be so gently adapted that none or only small contact pressure peaks occur. This has the result that in the case of a reel 6 having a large diameter (in particular, if the winding radius approaches a range which corresponds to the predetermined winding progress) and given, inexpensive hydraulics, the adaptation cannot be greater than that allowed by the resolution capacity of the hydraulics for the speed. Even if the displacement speed should temporarily come to a standstill, no contact pressure peaks occur since the speed variation is the smallest possible despite full winding speed.

Specifically, the adaptation of the displacement speed is carried out in such a manner that this is changed by a small amount in a first step. If the sensor 13 then detects a backward movement of the contact roller 4 toward its desired position, it stays with the adaptation made; if not, the displacement speed is varied by a further step and so on, until the contact roller 4 moves back toward its desired position. As a result, the displacement speed can be very finely adapted (optimally with respect to a given drive) and accordingly the smallest possible speed differences are used, so that the contact pressure remains undisturbed. Due to this regulation of the displacement speed, the system can be considered to be self-optimizing.

In another embodiment, a further optimization can be made whereby the displacement speed is no longer set to the original value when the contact roller 4 has reached its desired position, but to a value which in turn differs by a small amount from the original value. If the contact roller 4 has returned to its desired position again from behind, the original displacement speed was too low and is now increased by a step; if the contact roller 4 has again reached its desired position from the front, the original displacement speed was too high and is reduced by a step.

In other words, the adapted displacement speed is reversed in such a manner that this is set to a value which lies a speed interval above or below the calculated desired displacement speed in such a manner than the desired radius better corresponds to the actual radius.

As a result, particularly a systematic errors in the calculation of the desired radius can be counteracted.

The machine control 30 is therefore configured to perform the functions described above and hereinafter; starting from the present functional description, the person skilled in the art can easily create the control software with reference to the given specific design of the winder. This applies likewise to the necessary parameter, e.g. the size of the steps for adapting the displacement speed.

When the reel 6 has finished winding, which corresponds to the winding progress usually provided, it cuts through the material web 3 to relieve the transverse separating system not shown in FIG. 1. Such transverse separating systems for winders of the present type are known in the prior art. After the cutting, the machine control 30 pivots the pair of supporting arms 17 toward the depositing unit 2 for finished reels 6 and deposits the finished reel 6 there. The pair of supporting arms 17 is then pivoted back into its starting position to await the winding core 5 which has started to be wound, and receive it in its winding core bearing 15. The winding cycles then begins anew.

Directly before the cutting by the transverse separating system, the feed device 45 lowers the next winding core 5 (see double arrow 48 in FIG. 1) and places this in the forks 47 of the auxiliary receiving device 46. At the same tie, the transverse separating system makes the cut, whereupon on the one hand, as mentioned, the pair of supporting arms pivots away with the finished reel 6 and on the other hand, the new winding core 5 for winding is brought in contact with the front end of the freshly cut material web 3 resting on the contact roller 4.

After winding begins, the auxiliary receiving device 46 pivots in the counterclockwise direction (see FIG. 1) and transfers the winding core 5 which has started to be wound, into the winding core bearing 15 of the pair of supporting arms 17 which has now pivoted back.

This process involving the flying change of the reel is also known per se in the prior art. The winder according to the invention is configured in such a manner that the flying change can be executed in the known manner.

If the winder 1 according to the invention is to be operated with gap winding, it is sufficient to input the desired gap dimension via the control line 32, whereupon the control calculates the displacement speed so that the gap is always maintained. The dimension of the gap is preferably such that in the event of faults, e.g. due to incorrect specification of the thickness d of the film 3, the gap cannot be closed before the desired winding progress has been achieved (completely wound reel 6). As a result, light barriers etc. according to the constructions known in the prior art, are superfluous. Thus, in addition to contact winding, gap winding can also be improved by the method according to the invention.

Although various embodiments have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention as set forth herein.

The invention claimed is:

1. A method for producing a reel of a web of flexible material, the method comprising:

guiding the web of flexible material over a contact roller of a winder;

winding the web of flexible material onto a winding core;

pressing the contact roller onto the reel with a contact pressure thereby keeping continuous contact with said reel;

moving the winding core away from the contact roller at a reference displacement speed determined independently of the contact pressure and corresponding to a reference radius of the reel until a predetermined winding progress of the reel is achieved;

wherein, during winding, the contact roller remains in a reference position if the reference radius corresponds to an actual radius of the reel;

wherein if the actual radius of the reel deviates from the reference radius, the contact roller is correspondingly displaced from the reference position due to continuous contact with the reel;

increasing the reference displacement speed when the contact roller is away from the reference position in a direction away from the winding core; and decreasing the reference displacement speed when the contact roller is away from the reference position in a direction towards the winding core.

2. The method according to claim 1, wherein:

during displacement of the contact roller from the reference position caused by the actual radius of the reel differing from the reference radius, a displacement speed of the contact roller is adapted in such a manner that the contact roller returns back into the reference position;

wherein the winding core is moved further away at the reference displacement speed; and a renewed displacement of the contact roller from the reference position is reversed by adaptation of the reference displacement speed until a predetermined winding progress of the reel is achieved.

3. The method according to claim 2, wherein responsive to detection of a pulsating displacement of the contact roller caused by out-of-round winding, a centre of a displacement range is determined and the displacement speed is adapted in such a manner that the centre of the displacement range is guided towards the reference position of the contact roller.

4. The method according to claim 3, wherein a contact pressure resulting from out-of-round winding is adapted such that the contact pressure is temporarily increased when the contact roller is pressed out from a reference mounting into a rear area of the displacement range.

5. The method according to claim 2, wherein:

a substantially identical correction cycle of the displacement speed is interpreted as a systematic error in determination of the reference radius and determination of the reference radius is corrected in such a manner that the reference radius corresponds to an actual radius.

6. The method according to claim 2, wherein the displacement speed is corrected as little as possible when the reel radius is approaching a range which corresponds to that of the predetermined winding progress.

7. The method according to claim 2, wherein:

adaptation of the displacement speed is effected in steps;

after a first adaptation step, it is detected whether the contact roller is shifted back into the reference position, in which case the adaptation is made;

if the contact roller is not shifted back towards the reference position, a further adaptation step is carried out; and it is again detected whether the contact roller shifts back into the reference position.

8. The method according to claim 2, wherein an adapted displacement speed is reversed and set to a value which lies an interval below or above the reference displacement speed.

9. The method according to claim 1, wherein the reference radius is determined from a length and a thickness of the web of flexible material.

10. The method according to claim 9, wherein a systematic error in the determination of the reference radius is corrected by adapting a value for the thickness of the web of flexible material.

11. A winder comprising:

a carrier arrangement, wherein the carrier arrangement comprises:

a winding core bearing adapted to receive a winding core of a reel;

a contact roller;

a device adapted to vary a relative position between the winding core bearing and the contact roller;

means for producing a contact pressure between the reel and the contact roller, wherein the means comprises a machine control;

wherein the contact roller is mounted floatingly around a reference position in a direction of the winding core bearing and away therefrom;

wherein the means for producing the contact pressure cooperate operatively with the contact roller;

wherein the device comprises a drive configured to move the winding core bearing from a starting position at a beginning of winding away from the reference position of the contact roller independently of the action of a contact pressure transmitted through the contact roller until a predetermined winding progress is achieved;

wherein the machine control is configured to operatively trigger a drive in such a manner that the winding core bearing is moved substantially continuously away from the reference position of the contact roller at a displacement speed which continuously corresponds to an instantaneous increase in a reference radius of a winding bale;

wherein, during winding, the contact roller remains in the reference position if the reference radius corresponds to an actual radius of the reel;

wherein the machine control is operable to trigger the drive such that the displacement speed is increased when the contact roller is away from the reference position in a direction away from the winding core bearing; and wherein the machine control is operable to reduce the displacement speed when the contact roller is away from the reference position in a direction towards the winding core bearing.

12. The winder according to claim 11 further comprising:

sensors operable to detect an actual position of the contact roller; and responsive to a displacement of the contact roller from the reference position detected by the sensors, the machine control is operable to adapt the displacement speed such that the contact roller is guided back into the reference position.

13. The winder according to claim 11 wherein:

responsive to a displacement of the contact roller pulsating synchronously to a number of revolutions of the reel, the machine control is operable to adapt the displacement speed such that the contact roller is guided with a centre of a displacement interval back to the reference position.

14. The winder according to claim 13, wherein the machine control is operable to temporarily increase the contact pressure when the contact roller is pressed out from the reference position into a rear area of the displacement interval due to the reel being out of round.

15. The winder according to claim 11, wherein:

the machine control is operable for one or more of the functions;

a substantially identical correction cycle is interpreted as a systematic error in the determination of the reference radius;

the determination of the reference radius is corrected such that the reference radius corresponds to an actual radius;

the displacement speed is corrected as little as possible when the reel radius approaches a range, which corresponds to that of the predetermined winding progress;

the adaptation of the displacement speed is effected in steps such that after a first adaptation step, it is detected whether the contact roller is shifted back into the reference position;

if the contact roller is not yet shifted back toward the reference position, a further adaptation step is carried out until the contact roller actually shifts back into the reference position; and the adapted displacement speed is reversed such and set to a value, which lies an interval below or above the reference displacement speed.

16. The winder according to claim 11, wherein:

a carrier arrangement comprises a pair of supporting arms for the winding core bearing; and the drive pneumatically or hydraulically acts on the pair of supporting arms.

17. The winder according to claim 11, wherein the means for producing the contact pressure comprise a pneumatic or a hydraulic drive operatively connected to the contact roller.

18. The winder according to claim 11, wherein the contact roller is suspended on a bearing arrangement.

19. The winder according to claim 18, wherein the bearing arrangement is configured as a pendulum such that the contact roller can be displaced in a pendulum manner with a lowest position corresponding to the reference position toward the winding core bearing and away therefrom.

* * * * *